US005829467A

United States Patent [19]

Spicher

[11] Patent Number: 5,829,467

[45] Date of Patent: Nov. 3, 1998

[54] RESIDENTIAL HOT WATER CIRCULATION SYSTEM AND ASSOCIATED METHOD

[76] Inventor: Vincent M. Spicher, 126 Deerfield Dr., Petersburg, Va. 23805

[21] Appl. No.: 814,919

[22] Filed: Mar. 12, 1997

Related U.S. Application Data

[63] Continuation of Ser. No. 574,676, Dec. 19, 1995, abandoned.

[51] Int. Cl.[6] ..... F16K 49/00

[52] U.S. Cl. ..... 137/14; 137/362; 137/563; 137/624.12; 251/129.04

[58] Field of Search ..... 137/624.12, 565, 137/563; 126/362; 417/14, 12; 251/129.04

[56] References Cited

U.S. PATENT DOCUMENTS

| | | | |
|---|---|---|---|
| 4,142,515 | 3/1979 | Skaats | 126/362 |
| 4,201,518 | 5/1980 | Stevenson | 417/12 |
| 4,450,829 | 5/1984 | Morita et al. | 126/362 |
| 4,606,325 | 8/1986 | Lujan, Jr. | 126/362 |
| 4,750,472 | 6/1988 | Fazekas | 417/12 |
| 4,936,289 | 6/1990 | Peterson | 126/362 |
| 4,945,942 | 8/1990 | Lund | 417/12 |
| 5,009,572 | 4/1991 | Imhoff et al. | 417/32 |
| 5,042,524 | 8/1991 | Lund | 137/337 |
| 5,105,846 | 4/1992 | Britt | 126/362 |
| 5,143,049 | 9/1992 | Laing et al. | 126/362 |
| 5,205,318 | 4/1993 | Massaro et al. | 251/129.04 |
| 5,261,443 | 11/1993 | Walsh | 137/337 |
| 5,277,219 | 1/1994 | Lund | 417/12 |
| 5,351,712 | 10/1994 | Houlihan | 417/12 |

*Primary Examiner*—A. Michael Chambers
*Attorney, Agent, or Firm*—Maginot, Addison & Moore

[57] ABSTRACT

A residential hot water recirculation system recirculates cooled hot water into the base of the hot water heater through its drain valve using an electrically driven pump. The recirculation system incorporates portable self-contained signalling units which use photosensitive, motion sensitive or infrared sensitive detectors to sense changes within their field of sensitivity to signal the pump controller to activate the pump. By being portable and self-contained, the detectors can be placed without regard to home power outlets and without the need for additional wiring. The system provides for setting the cycle time for pump activation and the minimum interval between pump activations as well as a manual override which will reinitiates pump activation without regard to pump or timer status. The system signalling units and controller in one embodiment transmits and differentiates between two radio frequencies to distinguish between normal activation signals and manual override signals.

22 Claims, 4 Drawing Sheets

RESIDENTIAL HOT WATER CIRCULATION SYSTEM AND ASSOCIATED METHOD

This application is a continuation of application Ser. No. 08/574,676, filed Dec. 19, 1995 now abandoned.

This invention relates to residential hot water distribution systems and more specifically to a system which can be installed after home construction is complete without rewiring or replumbing and which provides circulation of hot water in anticipation of demand as well as on demand.

Problem

In conventional residential hot water systems, a cold water supply line is provided to the top of the hot water heater and a hot water distribution line exits from the top of the hot water heater. The hot water distribution line branches to each hot water faucet and tap.

The problem is that water in the hot water distribution line cools when the faucets and taps are turned off, permitting no water flow. Consequently, when a faucet is turned on, the exiting water is cooler than desired and the user will let the water run until the cooled hot water is purged from the line and hot water closer to the temperature to which it is heated by the hot water heater is emitted at the faucet.

From an environmental and conservational perspective, this is wasteful. From the personal perspective of the user, this is time consuming; it increases water consumption with a consequent increase in the user's water bill; and is a personally aggravating when one wants hot water and gets an unexpected cold alternative.

A variety of solutions to this problem have been provided. While arguably all of them improve the water temperature at the hot water tap, all require changes in either the household plumbing or electrical wiring. Moreover, none are easily installable by the typical home owner; none anticipate demand; and many are not energy efficient.

For example, see U.S. Pat. No. 5,277,219 to Lund which claims to provide a retrofit capability but requires that connections be made between the hot and cold water supply lines somewhere in the house for connection of the pump. Further, Lund requires that either a manual switch or a flow sensor be installed and the switch or the sensor must be hard-wired back to the control system for the pump. In operation, Lund will cause cold water from the residential supply line—the coldest water in the house—to enter the hot water heater as water is directed from the hot water supply line into the cold water supply line, a not particularly energy efficient approach. What we have with Lund, then, is a system which requires both plumbing and electrical work, which puts warm water in the cold water line and which causes more cold water to enter the hot water heater. All in all, not a quick, energy efficient or direct solution.

Also, see U.S. Pat. No. 5,205,318 to Massaro et al. which claims to be easily installed as a retrofit unit. Massaro's unit comprises a manifold which is installed underneath a sink into which are connected both the hot and cold water supply lines and from which exit both the hot and cold water lines to the faucet. A pump is located upstream of the manifold between the hot water heater and the manifold. The manifold contains a cross-over line between hot and cold water lines, a check valve and a thermostatic switch. A sending unit using modulated signals transmitted over the house AC power lines connects at a wiring receptacle and a receiving unit is likewise plugged into a wiring receptacle with the pump. The Massaro system is manually activated by a user activating the sending unit. Massaro requires that the hot water supply line be broken and the pump installed between the hot water heater and the manifold. Massaro requires further that four connections be made at the manifold with the potential for leakage at each connection. Like Lund, in operation, Massaro will cause cold water from the cold water residential supply line to enter the hot water heater, reducing energy efficiency of the hot water system. Because it uses the household wiring system to transmit signals, Massaro is limited to layouts which permit the sending unit to be near an electrical outlet for connection.

A further example is U.S. Pat. No. 5,009,572 to Imhoff et al. which has a cross-over line between the hot and cold water supply lines for outlet fixtures at one or more locations in the house. The cross-over pipe includes a pump which is automatically activated by a thermostat so that any time the water temperature in the hot water supply line drops below a preset temperature the pump is automatically activated to purge the cooled hot water into the cold water line. Imhoff requires four connections to work and will constantly cycle on and off regardless of user demand. This constant cycling is energy inefficient being unrelated to potential user demand.

Moreover, statements in the prior art like, "the control is plugged into a standard AC outlet receptacle," do not really demonstrate any convenience for the home owner unless the outlet exists at or near the location of the unit requiring power. For example, while it is easy to state that a switch would be installed adjacent every hot water outlet and a flow sensor installed in every hot water outlet line, it is considerably more difficult to accomplish this in an existing residence since wiring will have to be run, a receptacle and box installed and the surrounding wall finished and painted; access to the piping at the appropriate position made to install the sensors, the hot water line cut to allow sensor installation and those sensors wired back to the pump and valve controls.

Clearly, there is a need in the art for a device which can be easily installed as an aftermarket item and which provides increased convenience to residential homeowners.

Solution

The instant invention overcomes the shortcomings of the prior art by providing a novel hot water circulating system which can be easily installed in existing residences without the need to modify existing piping and wiring and which provides a control mechanism which minimizes installation and maximizes convenience.

The instant invention is comprised of one or more signalling units, a base receiver/control unit and mechanicals. The signalling units are themselves three-part units having a self-contained power source.

The first part of each signalling unit is a detector which is activated by an indication of potential demand. This is a major improvement in the instant invention over the prior art. Prior art devices either have the user turn the pump on, or have a sensor turn the pump on when the hot water is turned on, or have a sensor turn the pump on according to a temperature setting or a time interval. In contrast, the instant invention anticipates user demand by sensing activity in the room. For example, in a seldom used bathroom, the detector may be photosensitive, so that when a light is turned on, the sensor is activated. As another example, in a kitchen where foot traffic is heavier, the detector may be infrared with the field or intensity adjusted to detect a person in proximity to the sink and cabinets but not around the stove or refrigerator. Finally, in a master bath/bedroom area, the detector may be a motion detector which senses movement in the bedroom. Thus, the detector could sense when a person comes into the room or gets up. The instant invention appreciates and uses in different embodiments light, heat and motion as the condition to be detected in anticipating demand.

The second part of each signaling unit is a control switch which permits the unit to be (i) turned OFF so that it will not transmit upon detector activation; (ii) turned ON so that the activation of the detector will result in signal transmission; (iii) MANUALLY ACTIVATED so that, whether turned ON or OFF, a user can manually initiate an activation signal transmission.

The third part of each signaling unit the signal transmitter. In the preferred embodiment the transmitter sends an RF (radio frequency) signal of set frequency, duration and power. Because the unit is self-contained, requiring no connection to an external power source, each signalling unit can be located without regard to its proximity to an electrical outlet. Furthermore, because it is wireless and because no physical connection need be made between the signaling unit and the water supply line or faucet, physical access between the signaling unit and the pump or the faucet need not be considered during installation. This permits the homeowner to concentrate on just the two concerns, "What is the best type of detector to anticipate use in a particular application?" and, "What is the best placement for the detector so that the system works when I want it to?" This is a major improvement over prior art devices.

The base receiver/control unit incorporates an RF transceiver which receives the signals from the various signaling units throughout the home. The base receiver/control unit also incorporates an adjustable timer which serves two purposes. First, the timer controls the interval during which the mechanicals operate and, second, the timer controls the interval between one signal and the next which will activate the mechanicals.

The mechanicals are comprised of a fractional horsepower recirculating pump driven by an electric motor and a check valve at the pump outlet which limits water flow to a single direction.

Advantageously, the base receiver/control unit and the mechanicals are assembled in a single cabinet making it easy for the homeowner to transport and install. The cabinet is installed between the drain valve on the residential hot water heater and a nearby hot water bib-type faucet, that is, one which is threaded to permit attachment of a standard garden hose. Hoses connecting between the hot water faucet and the cabinet and between the cabinet and the hot water heater drain valve are the metal braided type usual to washing machine installations. This provides a flexible hose easily installed by the homeowner but which is resistant to abrasion and cutting.

In operation, upon tripping of a sending unit, the transceiver receives the signal and provides power to the recirculating pump which pumps water from the faucet to which the unit is connected into the opened drain line valve of the hot water heater. Thus, no cold water enters from the cold water inlet into the hot water heater to make up the water purged from the hot water lines, instead, the cooled hot water is recirculated back into the hot water heater making the system more energy efficient to operate since the warmer water will take less time to heat. The timer is tripped upon signal receipt which permits the pump to operate for a preselected period of time. While the operating period is adjustable, no more than about four minutes is usually required to purge the hot water lines sufficiently. The timer also times the interval between signals after which another signal will cause activation. After purging, the hot water lines do not need to be again purged until the water has again cooled. The adjustable timer, after being activated and activating the pump, will prohibit activation of the pump again until sufficient time has passed for the hot water to cool. Since hot water cool-down is affected by seasonal temperature changes as well as by the particular water supply layout in the home, the timer is separately adjustable for this reset interval as well.

Thus, the present invention provides a unit which is extremely convenient to the homeowner because it is readily installed without in-wall wiring or modification of existing plumbing and piping. Further, it anticipates usage by sensing a condition which the homeowner has selected as an indication of potential need for hot water and initiates and accomplishes hot water circulation without the need for the user to manually initiate hot water circulation.

In accordance with one aspect of the invention a hot water recirculating unit is provided which is connected between a faucet and the drain valve of the hot water heater.

In accordance with another aspect of the invention, a hot water recirculating unit is provided with a signalling unit which in one mode is activated automatically by heat, light, motion or other condition and in another mode is activated manually.

In accordance with yet another aspect of the invention, a hot water recirculating unit is provided with a signalling unit which is capable of providing two distinguishing signals, one for automatic activation and one for manual activation, with the latter causing the controller to override the reset period timer.

In accordance with a further aspect of the invention, the signalling units are self-contained.

In accordance with another further aspect of the invention, the controller for the recirculating unit permits the user to adjustably select both the length of time the recirculating pump will run and the reset period, that is, the time from one signal to the next which will initiate pump activation.

In accordance with a still further aspect of the invention, the pump is designed to prevent water circulation when the pump is not activated.

DETAILED DESCRIPTION

Figure 1:
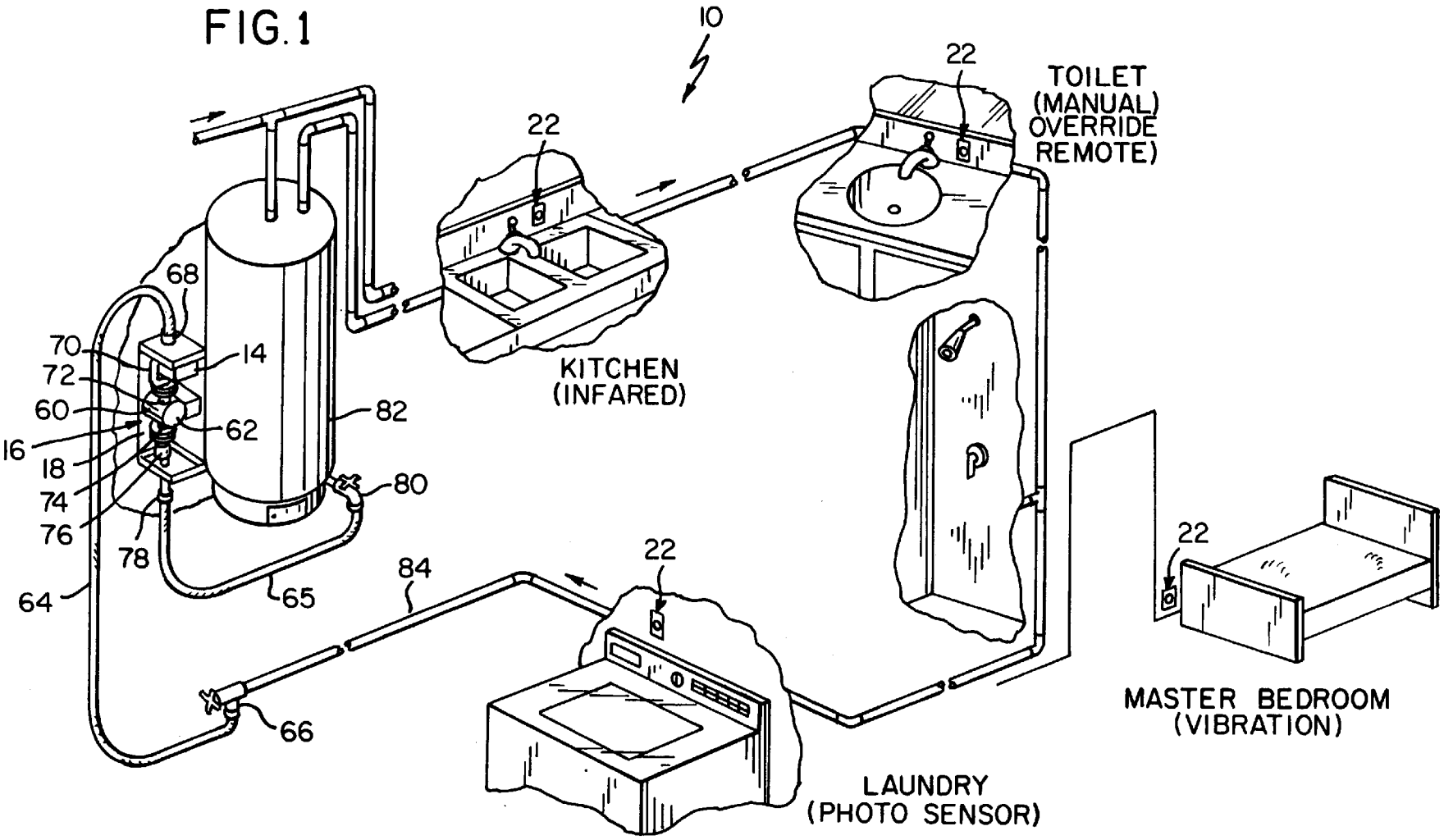
FIG. 1 is a schematic of the system indicating that the general configuration of the system components in a typical residential layout.
Figure 2:
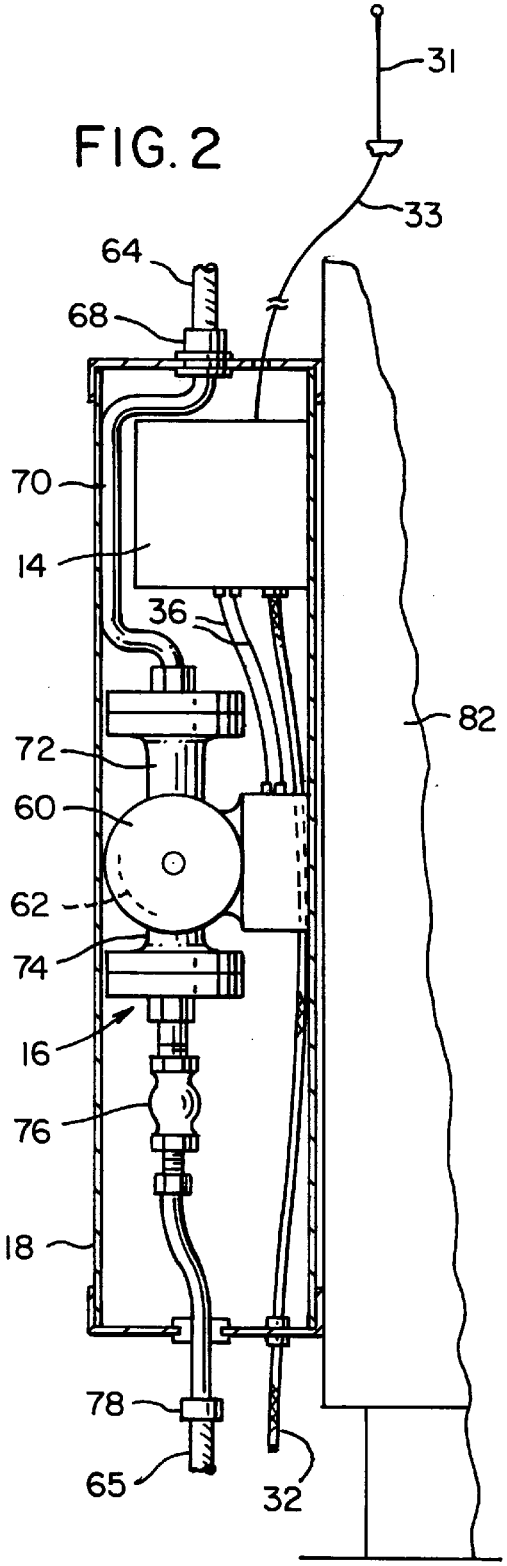
FIG. 2 is a front view of the open cabinet of the instant invention containing the hose connections, pump and motor, valve, controller unit, POWER light, and antenna for the base receiver unit.

As shown in FIG. 1, the hot water recirculation unit 10 of the instant invention has three primary components, portable self-contained signaling units 12, base receiver/controller 14, and recirculation mechanicals 16. In the preferred embodiment, illustrated in FIG. 2, the base receiver/controller 14 and the recirculation mechanicals 16 are contained in an operating cabinet 18.

Each signaling unit 12 incorporates detectors 20. The current invention appreciates that different types of detectors, e.g., detectors which are photo sensitive, heat sensitive, or vibration sensitive, are appropriate for different applications and therefore each signalling unit 12 can contain one or more detectors, each detector 20 sensing a different physical environment change, and different signaling units can contain different detectors. In the preferred embodiment, three different types of detectors are used. One detector is vibration sensitive, another is photosensitive and the third is infrared sensitive. It is recognized and appreciated that additional detectors can be used, for example, a light beam detector or a sound detector can also be utilized. Each detector incorporates a manual adjustment to increase or decrease the sensitivity to limit the field of the detector to control true versus false indications which trigger the detector. Thus, for example, an infrared detector can be set at a low sensitivity setting in a high traffic area so that only movement directly adjacent a sink results in a detection and signal and another infrared detector can be set at a high sensitivity setting such that any movement in a room or hallway results in a detection and signal.

While the signalling units 12 of the instant invention are custom units, similar detectors exist for other applications, notably for home security lighting applications. For example, the following detectors can be adapted for use as part of the signalling unit 12: A self-contained infrared motion sensor for home security systems, the sensitivity of which is adjustable, is available from Radio Shack, a division of Tandy Corporation, Fort Worth, Tex., as Catalog No. 49-208; a self-contained vibration detector for home security systems is also available from Radio Shack as Catalog No. 49-521; a motion activated lighting system known as the 300 Watt/110° from The Brinkman Corporation of Dallas, Tex. incorporates both an infrared motion sensor and a photosensor which is light level adjustable; and a motion activated floodlight containing an infrared detector which incorporates a motion sensitivity adjustment and which activates the light is available from Regent Lighting Corporation of Burlington, N.C. as models MS-35 or MS-37.

Figure 5:
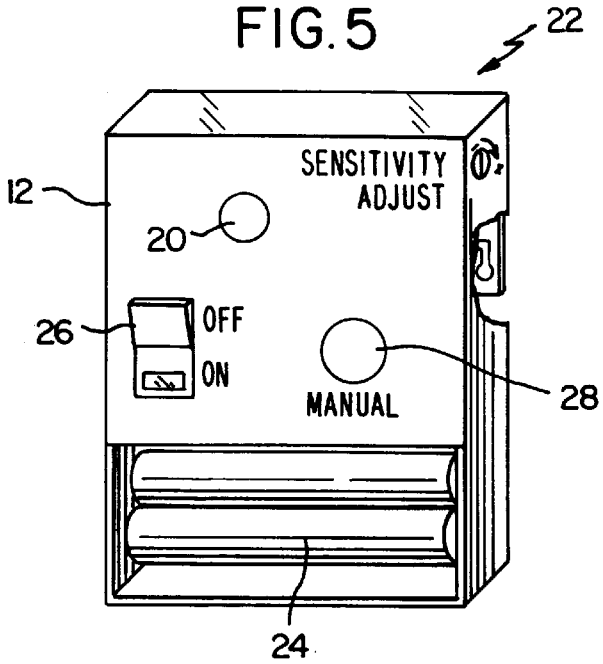
FIG. 5 is an illustration of the signaling unit showing the ON/OFF switch and the MANUAL OVERRIDE button.
Figure 6:
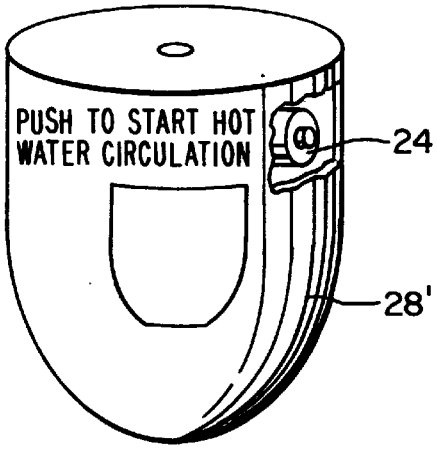
FIG. 6 is an illustration of the remote MANUAL OVERRIDE button which can be located separately from the signaling unit.

Upon sensing a change, a detector 20 activates a channel of a two channel radio frequency (RF) transmitter 22. An example of a similar signaling unit is the Pocket Remote sold by Radio Shack as Cat. No. 61-2663 which is a two channel RF transmitter. The third part of the signalling unit is a two position switch 26 which controls power being provided by a self-contained power source 24. In the OFF position, the detector(s) 20 is not powered and will not activate the transmitter 22. In the ON position, the detector is powered and will activate the transmitter. The signaling unit incorporates a MANUAL OVERRIDE button 28. In the preferred embodiment shown in FIG. 5, the MANUAL OVERRIDE button 28 is incorporated as a momentary switch which is part of the signalling unit 12 and which will activate the transmitter regardless of the position of switch 26. However, in a second embodiment shown in FIG. 6, the MANUAL OVERRIDE button 28 is a separate self-contained RF transmitter 28' which transmits at the MANUAL OVERRIDE frequency, that is, the Channel B frequency. In this alternative embodiment, the remote MANUAL OVERRIDE unit 28' provides a direct signal to the receiver/controller 14, although it is recognized that the remote override unit could also be used to activate just the associated signalling unit 12 which, in turn, would signal the receiver/controller 14. In the second embodiment, the MANUAL OVERRIDE 28' can be installed separately from the signalling unit 12, permitting the signaling unit to be placed out of reach in an unobtrusive location while the MANUAL OVERRIDE 28' can be placed at a location convenient to a user, for example, near the light switch at the room entryway or adjacent the sink, tub or bed. The RF transmitter 22 will transmit at the Channel A frequency when activated by a detector 20 and at the Channel B frequency when activated by the MANUAL OVERRIDE button 28 or 28'.

The receiver/controller 14 is plugged into a standard 110 VAC outlet by its power cord 32 which provides power to the receiver/controller 14 through a transformer (not shown) and feeds a relay 47 to provide power to the pump motor as will subsequently be described. Receiver/controller 14 comprises a radio frequency (RF) receiver 30 capable of receiving both the Channel A and B frequencies of the signaling units 12 through an antenna 31. In the preferred embodiment, antenna 31 is removable from the receiver/controller 14 so that it can be mounted in a remote location if this proves necessary to signal reception, and is connected back to the receiver from such position by wire 33. A similar receiver is available from Intellectron of Hayward, Calif. as a BC 836 plug-in lamp receiver.

Figure 4:
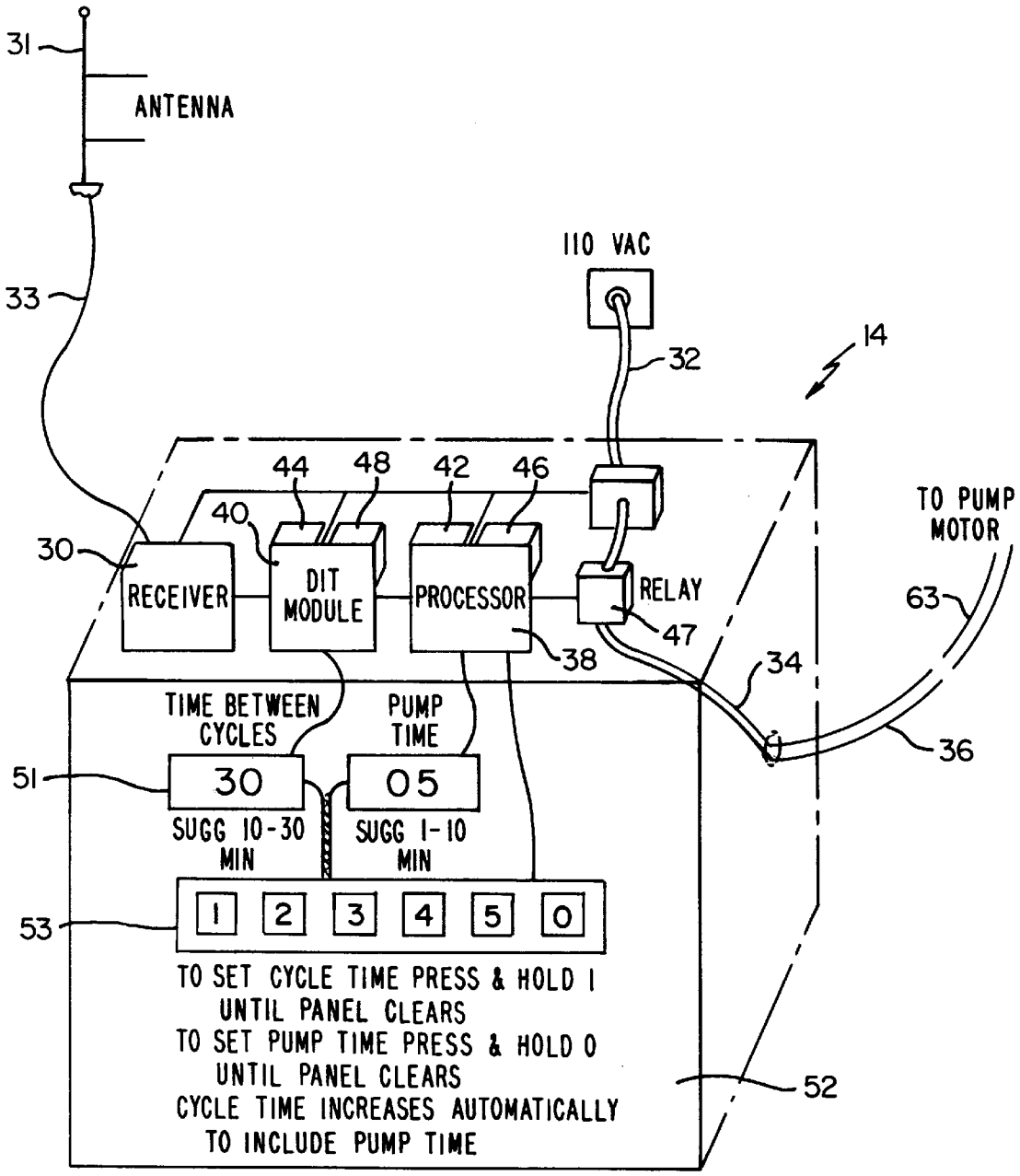
FIG. 4 is an illustration of the receiver/controller showing the timer controls.

As shown in FIG. 4, upon signal receipt over Channel A or Channel B, the RF receiver 30 relays the signal to Demand Interval Timer (DIT) Module 40 which, under appropriate conditions, relays the signal to the Pump Timer Module 38.

The DIT module 40 is an IC based unit which incorporates an electronic timer, DIT clock 44, and a DIT processor 48 which is capable of storing data such as the timer settings as is subsequently described. DIT module 40 is connected to a control panel 52 which includes an LCD display 51 and a key pad 53. As shown in FIG. 4, control panel 52 provides the homeowner a clear indication of the time between pump intervals, the Demand Interval Time, in minutes and a keypad which permits the homeowner to reset the Demand Interval Time by appropriate entries via the key pad 53 which are then displayed on the LCD display 51 as the time between cycles. The DIT processor 48 stores the Demand Interval Time setting and sets the DIT clock to time that interval. In the preferred embodiment, the Demand Interval Time is suggested to be between 10 and 30 minutes. This permits the user to control operation of pump 60 so that once pump 60 has been activated, the unit will not automatically reactivate pump 60 until the selected time period has passed. By allowing the homeowner to adjust the interval between periods during which pump 60 is in operation, the homeowner is able to keep the pump from operating until the water in the user's hot water supply system cools below a desired temperature. This interval adjustment allows the recirculation unit 10 to be energy efficient by not activating more often than is needed to keep water temperature in the hot water supply line within a desired range.

Connected to the DIT module 40 is a Pump Cycle Timer (PT) Module 38 which incorporates an electronic timer, PT clock 42, and a PT processor 46 capable of data storage such as the timer settings. As shown in FIG. 4, PT module 38 is likewise connected to control panel 52. The control panel LCD display 51 is divided to show both the time set for the Demand Interval Time and the time set for Pump Cycle Time, this latter time being controlled by the PT module 38. Control panel 52 provides the homeowner a clear indication of how long the pump will run each time it is activated and permits the homeowner to adjustably reset the Pump Cycle Time by appropriate entries via the key pad 53 which are then displayed on the LCD display 51. The PT processor 46 stores the Pump Cycle Time setting and sets the PT clock 42 to time that interval. Thus, control panel 52 also permits the homeowner to adjustably set the period of time the PT clock 42 will track which, in the preferred embodiment, is between 1 and 10 minutes. This permits the user to adjust the time that pump 60 operates to an period most advantageous to the needs of his hot water supply system to purge cooled hot water from the hot water supply line.

Recognizing that there is the potential for the homeowner to set the pump to operate for a Pump Cycle Time which is inconsistent with the Demand Interval Time, the DIT processor 48 establishes the time which the DIT clock 44 is to time as the sum of the Pump Cycle Time and the Demand Interval Time. For example, even though the LCD display for the Demand Interval Time is set for 5 minutes while the Pump Cycle Time is set for 30 minutes, the DIT clock 44 will time 35 minutes, the sum of the two times. This means that there will always be some interval between pump cycles.

As indicated above, the recirculation unit 10 permits automatic pump activation caused by detectors 20 and permits intentional pump activation caused by the user operating MANUAL OVERRIDE 28. In the preferred embodiment, the user's activation of the MANUAL OVERRIDE 28 will always cause pump activation regardless of when the pump was last activated or whether the pump is then activated.

Figure 3:
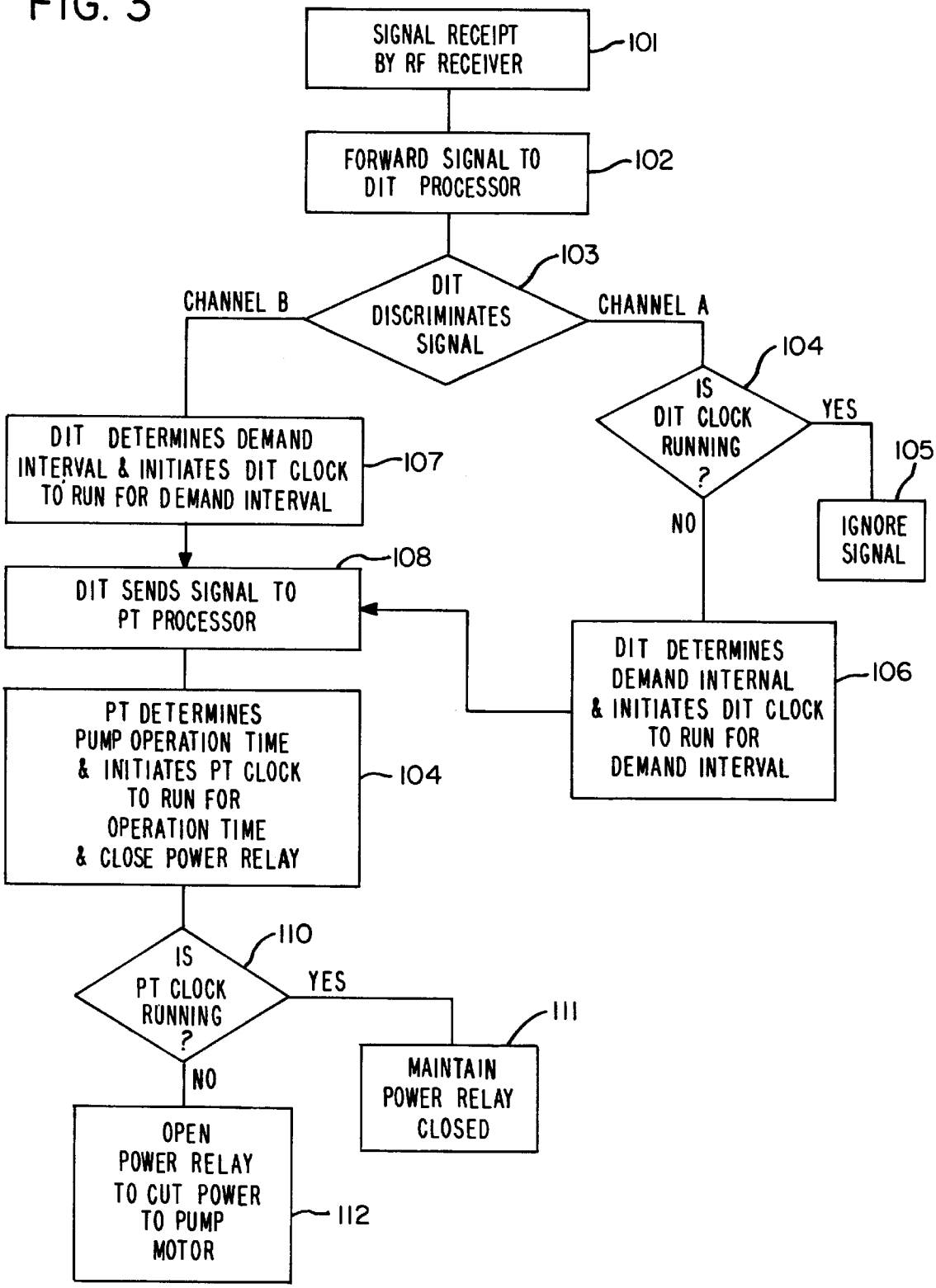
FIG. 3 is a flow chart of the controller operation to control pump initiation, run time, termination and reinitiation.

As shown in FIG. 3, signal processing in the receiver/controller 14 is accomplished as follows. Upon receipt 101 of the signal by the RF receiver 30, the signal is forwarded 102 to the DIT processor 48. The DIT processor determines 103 if the signal is a Channel A or Channel B signal. If the signal is a Channel A signal, the DIT processor 48 will query 104 DIT clock 44 to see if it is running which would indicate that the Demand Interval Time has not been satisfied. If the DIT clock 44 is running, DIT processor 48 will ignore 105 the signal. If the DIT clock 44 is not running, the DIT processor 48 determines the Demand Interval Time and initiates 106 the DIT clock 44 to run for this period and sends the signal on to the PT Processor 46. Upon receipt 108 of the Channel A signal, the PT processor 46 determines the Pump Cycle Time and initiates 109 the PT clock 42 to run for time set for the pump cycle and closes 111 relay 47 in power circuit 34, thereby completing the circuit between the power cord 32 and the outlet leads 36 connected to pump motor 62 which causes pump 60 to operate. The PT processor continues to poll the PT timer 42 and upon PT clock 42 timing through the pump operation time interval, the PT processor 46 deactivates 112 relay 47 which breaks power circuit 34 causing pump 60 to cease operation.

If the signal is a Channel B signal, the DIT processor 48 determines the demand interval, sets 107 DIT clock 44 time to zero 107, activates DIT clock 44 consistent with the Demand Interval Time, and sends 108 the Channel B signal to the PT processor 46. Upon receipt of the Channel B signal, the PT processor 46 determines 109 the Pump Cycle Time, sets the PT clock time to zero, activates the PT clock 42 to run for the Pump Cycle Time and closes relay 47 in power circuit 34, thereby completing the circuit between the power cord 32 and the outlet leads 36 connected to pump motor 62 which causes pump 60 to operate. Upon the PT clock 44 timing through the Pump Cycle Time, the PT processor 46 deactivates relay 47 which breaks power circuit 34 causing pump 60 to cease operation. While the processors 46&48 and the clocks 42&44 are described as separate devices, it is recognized that a single processor and clock will suffice and that the receiver, timer and clock can be integrated into a single device.

Turning to the recirculation mechanicals 16 of the instant invention, as can be seen in FIG. 1, a braided flexible inlet hose 64, common to washing machine installations, is connected between a hot water bib 66 and the threaded inlet connection 68. The inlet connection 68 is connected by piping 70 to pump inlet 72. Pump 64 is driven by electrical pump motor 62 which is provided electrical current from the power circuit 34 by power leads 63 connected to controller power circuit outlet leads 36. The pump and motor combination used in the preferred embodiment is Circulator, type UP 15-42 SF, manufactured by Grundfos Pumps Corporation of Clovis, Calif.

Pump outlet 74 connects to check valve 76 which, in turn, is connected to outlet connection 78. A braided outlet hose 65 connects between outlet connection 78 and hot water heater drain valve 80. With the recirculation mechanicals 16 so arranged, the instant invention is easily installed between an existing hot water bib near the hot water heater and the drain valve for the hot water heater. In operation, when pump motor 62 is activated, pump 60 takes water from the hot water line 84—with the bib 66 being its supply source—and pumps it into the hot water heater through drain valve 80. This approach requires no modification of the hot water heater inlet or outlet lines and uses an existing valve to move cooled hot water, rather than cold water from the cold water inlet, into the hot water heater for reheating, the cooled hot water thereby purged from the hot water supply line 84 being replaced by hot water from the hot water heater 82. When the pump 60 is not operating, check valve 76 prevents reverse flow of water through the circulation unit.

Obviously, the instant invention is most useful if the hot water bib 66 is toward the end of the hot water supply line run because this permits cooled hot water to be purged from a larger volume of the line. However, any circulation of hot water through any portion of the hot water supply line will, through convection, cause the remaining cooled water in the line to also increase in temperature and the longer the hot water is circulated the greater the amount of convection increasing the average water temperature throughout the line.

As can be seen, the instant invention provides a compact control and mechanicals unit which is easily installed using hoses to connect mechanicals to existing hot water outlets, while a single power cord provides power to both the pump and the receiver/controller. Advantageously, the signaling units are internally powered and require no connection to the house wiring. Beneficially, different types of detectors can be utilized with the system. Examples shown in FIG. 1 include a vibration type motion detector used in a bedroom so that hot water is circulated as a person prepares for bed and again when he awakes in the morning. The detector is activated by footsteps in a particular area of the room. Also shown in FIG. 1, a photosensor type detector is used in a windowless utility area so that hot water is circulated when the lights are turned on when preparing to do laundry. Further shown in FIG. 1, is an infrared type detector which is used in a kitchen area with sensitivity turned down to scan only an area within several feet of the kitchen sink and cabinets. Also shown in FIG. 1, is a MANUAL OVERRIDE remote which is placed adjacent a sink in a work room routinely used for crafts, hobbies and home repairs. As is evident, the detectors can all be the same type or may be different and need not be placed adjacent a hot water supply location. Instead, by placing the detectors in an area where occupancy tends to indicate a potential for hot water usage, the recirculation unit can anticipate need and commence circulation even before the user enters the room in which the hot water faucet is located.

It will be understood that the above description of the present invention is susceptible to various modifications, changes and adaptations, and the same are intended to be comprehended within the meaning and range of equivalents of the appended claims.

I claim:

1. A method of recirculating hot water in a hot water distribution system which includes a water heater, a pump, a water conduit, and a water outlet, with (1) the water conduit being connected to the water heater, and (2) the water outlet being connected to the water conduit, comprising the steps of:

determining whether a received signal is (1) a control signal which was generated in response sensing a human being, or (2) a manual override signal which was generated in response to manual activation of a manual override switch;

activating the pump if the received signal is the manual override signal;

activating the pump if (1) the received signal is the control signal, and (2) a predetermined time period after an initial activation of the pump has expired, wherein the predetermined period of time is based on a stored value in a controller; and preventing activation of the pump if (1) the received signal is the control signal, and (2) the predetermined time period has not expired.

2. The method of claim 1, wherein:

the control signal is transmitted on a first channel, the manual override signal is transmitted on a second channel, and the determining step includes the step of determining whether the received signal was (1) transmitted on the first channel, or (2) transmitted on the second channel.

3. A method of recirculating hot water in a hot water distribution system which includes a water heater having a hot water outlet and a drain valve, a pump having a pump inlet and a pump outlet, and a hot water supply conduit, with (1) the hot water supply conduit being fluidly coupled to both the pump inlet and the hot water outlet of the water heater, and (2) the pump outlet being fluidly coupled to the drain valve of the water heater, comprising the steps of:

sensing the presence of light and generating a control signal in response thereto; and operating the pump in response to generation of the control signal so as to advance hot water from the hot water outlet of the water heater, through the hot water supply conduit, and into the drain valve of the water heater.

4. The method of claim 3, wherein the sensing step includes the step of detecting activation of a light source with a photosensitive detector, and generating the control signal in response thereto.

5. The method of claim 3, further comprising the steps of:

transmitting the control signal from a first antenna;

receiving the control signal with a second antenna; and activating the pump in response to receipt of the control signal with the second antenna.

6. A hot water recirculation device, comprising:

a water heater having a hot water outlet and a drain valve;

a pump having a pump outlet and a pump inlet;

a hot water supply conduit, wherein a first end of said hot water supply conduit is connected to said hot water outlet of said water heater;

a bib connected to a second end of said hot water supply conduit;

a pump inlet conduit which fluidly couples said bib to said pump inlet;

a pump outlet conduit which fluidly couples said pump outlet to said drain valve of said water heater;

a detector for sensing the presence of a human being and generating a control signal in response thereto; and a circuit for receiving said control signal and activating said pump in response thereto so as to cause hot water to be advanced from said water heater to said hot water supply conduit and through said bib.

7. The device of claim 1, wherein said detector is chosen from the group consisting of: an infrared detector, a vibration detector; a broken light beam sensor, and a sound sensor.

8. The device of claim 1, wherein:

said detector includes means for transmitting said control signal from a first antenna, and said circuit includes means for receiving said control signal on a second antenna.

9. The device of claim 1, further comprising:

a controller having a memory which includes a first storage area and a second storage area;

means for operating the pump for a first predetermined time period after an initial activation thereof based on data stored in the first area of the memory; and means for preventing a subsequent activation of the pump for a second predetermined time period after said initial activation thereof based on data stored in the second area of the memory.

10. A method of recirculating hot water in a hot water distribution system which includes a water heater having a hot water outlet and a drain valve, a pump having a pump inlet and a pump outlet, and a hot water supply conduit, with (1) the hot water supply conduit being fluidly coupled to both the pump inlet and the hot water outlet of the water heater, and (2) the pump outlet being fluidly coupled to the drain valve of the water heater, comprising the steps of:

sensing the presence of a human being and generating a control signal in response thereto; and operating the pump in response to generation of the control signal so as to advance hot water from the hot water outlet of the water heater, through the hot water supply conduit, and into the drain valve of the water heater.

11. The method of claim 10, wherein the sensing step includes the step of detecting the presence of the human being with an infrared detector, and generating the control signal in response thereto.

12. The method of claim 10, wherein the sensing step includes the step of detecting the presence of the human being with a vibration detector, and generating the control signal in response thereto.

13. The method of claim 10, wherein the sensing step includes the step of detecting the presence of the human being with a broken light beam sensor, and generating the control signal in response thereto.

14. The method of claim 10, wherein the sensing step includes the step of detecting the presence of the human being with a sound sensor, and generating the control signal in response thereto.

15. The method of claim 10, further comprising the steps of:

transmitting the control signal from a first antenna;

receiving the control signal with a second antenna; and activating the pump in response to receipt of the control signal with the second antenna.

16. The method of claim 10, further comprising the step of:

storing data in a controller; and operating the pump for a predetermined time period after activation thereof based on data stored in the controller.

17. The method of claim 10, further comprising the step of:

storing data in a controller;

preventing a subsequent activation of the pump for a predetermined time period after an initial activation thereof based on data stored in the controller.

18. The method of claim 10, further comprising the step of:

activating a manual override mechanism so as to generate a manual override signal; and operating the pump in response to generation of the manual override signal so as to advance hot water from the water heater into the water conduit.

19. A hot water recirculation device, comprising:

a water heater having a hot water outlet and a drain valve;

a pump having a pump outlet and a pump inlet;

a hot water supply conduit, wherein a first end of said hot water supply conduit is connected to said hot water outlet of said water heater;

a bib connected to a second end of said hot water supply conduit;

a pump inlet conduit which fluidly couples said bib to said pump inlet;

a pump outlet conduit which fluidly couples said pump outlet to said drain valve of said water heater;

a detector for sensing the presence of light and generating a control signal in response thereto; and a circuit for receiving said control signal and activating said pump in response thereto so as to cause hot water to be advanced from said water heater to said hot water supply conduit and through said bib.

20. The device of claim 19, wherein said detector is chosen from the group consisting of: an infrared detector, a vibration detector; a broken light beam sensor, and a sound sensor.

21. The device of claim 19, wherein:

said detector includes means for transmitting said control signal from a first antenna, and said circuit includes means for receiving said control signal on a second antenna.

22. A residential water circulation system for supplying hot water and cold water, comprising:

a water heater having (i) a cold water inlet, (ii) a hot water outlet, and (iii) a drain valve;

a pump having a pump outlet and a pump inlet;

a hot water supply conduit, wherein a first end of said hot water supply conduit is connected to said hot water outlet of said water heater;

a bib connected to a second end of said hot water supply conduit;

a pump inlet conduit which fluidly couples said bib to said pump inlet;

a pump outlet conduit which fluidly couples said pump outlet to said drain valve of said water heater; and a cold water supply conduit fluidly coupled to said cold water inlet of said hot water heater, wherein (i) operation of said pump advances water along a hot water return path which includes each of said bib, said pump inlet conduit, said pump outlet conduit, and said drain valve, and (ii) water in said cold water supply conduit is isolated from water in said hot water return path when water is advanced along said hot water return path.

* * * * *